US008936278B2

(12) United States Patent
Salter et al.

(10) Patent No.: US 8,936,278 B2
(45) Date of Patent: Jan. 20, 2015

(54) BOOK COVER WITH PRINTED IMAGE

(71) Applicants: Richard Salter, Rochester, NY (US); Mark Anthony Harris, Rochester, NY (US); Cheryl Lenhard, Rochester, NY (US); William N. Richardson, Rochester, NY (US)

(72) Inventors: Richard Salter, Rochester, NY (US); Mark Anthony Harris, Rochester, NY (US); Cheryl Lenhard, Rochester, NY (US); William N. Richardson, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 20 days.

(21) Appl. No.: 13/762,613

(22) Filed: Feb. 8, 2013

(65) Prior Publication Data

US 2014/0227063 A1 Aug. 14, 2014

(51) Int. Cl.
*B42D 3/00* (2006.01)
*B42C 13/00* (2006.01)

(52) U.S. Cl.
CPC ..... *B42C 13/00* (2013.01)
USPC ..... 281/31; 281/29; 40/726; 40/771; 40/772; 40/775

(58) Field of Classification Search
CPC ..... B42D 3/00
USPC ..... 281/29, 31; 40/702, 726, 765, 772, 775, 40/776
See application file for complete search history.

(56) References Cited

U.S. PATENT DOCUMENTS

| | | | | | |
|---|---|---|---|---|---|
| 1,103,102 | A | * | 7/1914 | Thurston | 281/31 |
| 2,150,474 | A | * | 3/1939 | Williams | 281/31 |
| 2,925,675 | A | * | 2/1960 | Lumpkin | 40/643 |
| 4,001,960 | A | | 1/1977 | Holson | |
| 4,164,085 | A | | 8/1979 | Steeb et al. | |
| 4,172,332 | A | * | 10/1979 | Holes et al. | 40/726 |
| 5,025,581 | A | * | 6/1991 | Polzin | 40/776 |
| 5,165,721 | A | | 11/1992 | Schwartz | |
| 5,378,022 | A | | 1/1995 | French et al. | |
| 5,490,739 | A | | 2/1996 | Olson | |
| 5,904,373 | A | * | 5/1999 | Krapf | 281/29 |
| 5,974,715 | A | * | 11/1999 | Werner et al. | 40/772 |
| 6,003,901 | A | | 12/1999 | Takemura | |
| 6,305,714 | B1 | | 10/2001 | Rossetto et al. | |
| 6,845,582 | B1 | | 1/2005 | Ho et al. | |
| 2009/0284002 | A1 | | 11/2009 | Miranti | |
| 2010/0031549 | A1 | * | 2/2010 | Kenyon | 40/711 |

* cited by examiner

*Primary Examiner* — Kyle Grabowski
(74) *Attorney, Agent, or Firm* — Kevin E. Spaulding

(57) ABSTRACT

A system for affixing a printed image onto a book cover, comprising a sleeve having a front surface, a back surface and four edges. The sleeve includes a front layer having a transparent window region surrounded by an opaque mask region and a back layer joined to the front layer along at least two of the edges, wherein the back layer is not joined to the front layer along at least one of the edges thereby providing at least one open edge adapted to receive the printed image. Adhesive strips having peelable coverings are affixed onto the back surface of the sleeve along at least two of the edges. The opaque mask region is adapted to cover the edges of the printed image, and the adhesive strips are adapted to affix the sleeve onto the book cover.

6 Claims, 10 Drawing Sheets

BOOK COVER WITH PRINTED IMAGE

FIELD OF THE INVENTION

This invention pertains to the field of producing photo books and more particularly to a system for affixing a printed image onto a book cover.

BACKGROUND OF THE INVENTION

In recent years, the proliferation of digital photography has provided consumers with a variety of options to store and use captured images. These options include various "soft copy" methods involving memory cards, memory sticks, CD's, DVD's, hard drives, on-line storage etc. These "soft-copy" options, while providing the environmental benefit of eliminating the paper, ink or dye, and other chemicals required for "hard-copy" output, are potentially less secure for long term storage due to media format obsolescence, storage media physical or chemical breakdown, and on-line storage companies disappearing. A variety of options exist for customers to print digital images, including conventional silver halide processing, ink-jet, thermal dye transfer, and electrophotographic methods. These "hard-copy" methods are capable of providing printed output which can last for many decades. Although customers can make such "hard-copy" prints at home, modern retail outlets provide kiosks and order-terminals where both prints and additional services can be requested and provided. Similar services are also available from on-line companies such as Shutterfly.

An increasingly popular service provides photo albums or photo books with collections of images associated with a specific event, such as a vacation, family gathering, school function etc. The photo books are composed of printed images produced by any one of a wide variety of printing methodologies that are bound together in book form. The photo books can be custom made at retail stores or at centralized facilities.

In order to provide personalization, it is often desirable to provide an image on the cover of the photo book that can be viewed without opening the book. In this way, the cover image can provide an indication of the contents of the photo book.

The cover image can be provided in a variety of different ways, many of which are impractical for use in a home or retail environment. Some photo books are provided with printable front surfaces. However, this require specialized printing equipment capable of printing on a thick inflexible surface. This also limits options for the color of the photo book cover since a white background is required for a printable surface.

Some photo books include prefabricated covers that are provided with a window cut into the front cover that enables the first image in the book to be viewed while the book is closed. This approach has the disadvantage of not protecting the first print while the book is closed. Additionally, the window is typically much smaller than the size of the cover, thereby limiting the view of the first print. Furthermore, this approach constrains the cover image to correspond to the first image in the photo book which can sometimes distract from the context of the story being told through the sequential page sequence of the photo book.

Another technique for providing a cover image for a photo book involves heat laminating a printed image to the front surface of the book cover using heat activated adhesive activated using a lamination press. This approach requires expensive equipment and highly trained operators. Similarly, printed images can also be attached to photo book covers with pressure sensitive adhesives. A disadvantage of these approaches is that if the image is misaligned during the heat lamination process the photo book will be rendered useless and cannot be sold. Additionally, they are susceptible to entrapping air during the lamination process producing unsightly bubbles from the entrapped air. Furthermore, the surface and edges of the laminated image are exposed so that the cover image will be susceptible to physical damage and stains.

An additional technique utilizes a custom printed dust jack. This approach has the disadvantage that the dust jacket is subject to misalignment and damage, and can be easily separated from the book cover. It also requires printing on a large piece of media to encompass both the front and back cover, and performing a series of precise folds. Also dust jackets lack the pleasing aesthetic appearance of a custom produced and finished photo book.

U.S. Pat. No. 4,001,960 to Holson, "Photo album cover with framed insert," discloses a padded type photo album incorporating a metallic frame disposed in an opening in the album cover for displaying a photographic print.

U.S. Pat. No. 4,164,085 to Steeb et al., entitled "Album having picture receiving frame assembly in cover," discloses a keepsake album having a frame assembly embed in its padded front cover for displaying a personalized photograph.

U.S. Pat. No. 5,378,022 to French, entitled "Pouch for paper notebooks," discloses a transparent, flexible plastic pouch that attaches to the front cover of a notebook such as a spiral wire bound notebook and is used for containing personal items such as pencils, erasers and rulers. The pouch includes a flap or other type of closure for closing an interior pocket.

U.S. Pat. No. 5,490,739 to Olson, entitled "Window display photo album," describes a three-piece folder for holding a photograph that includes an aperture for viewing the photograph. The folder includes holes at one edge for mounting into a loose leaf binder.

U.S. Pat. No. 6,003,901 to Takemura, entitled "Combined photo album and picture frame and an easel therefor," discloses a combined photo album and picture frame including a front cover configured as a frame for holding a photograph. It also provides a plurality of pages for holding photographs and an easel for the structure. A pocket is provided in the back cover for storing the easel. This approach does not have the appearance and utility of a custom made photo album.

U.S. Pat. No. 6,305,714 to Rossetto et al., entitled "Folder with framed windows and method of manufacturing thereof," discloses a folder having a pocket panel and framed windows. A sheet containing content information is insertable within the pocket to be viewable through the framed windows.

U.S. Pat. No. 6,845,582 to Ho, entitled "Photo-frame style photo album," incorporates a conventional picture frame with internal pages of "loose-bags" designed to accept standard sized photo prints. It does not have the appearance and utility of a custom made photo album.

U.S. Patent Application Publication No. 2009/0284002 to Miranti, entitled "Board book photo album," describes a sturdy photo album with a plurality of stiff pages, each having die cutout opening and having a slot with an opening along an edge of the upper portion. Pieces of clear plastic are used to cover the die cutout openings in the pages. The album is designed for inserting two photographs, back to back, through the opening into the slot in the upper portion of each page and arranging the photographs for viewing through the die cutout openings in each page. This approach places a limit on the size of the photo book and the number of images that can be included. It also subjects the installed photographs to potential damage since there are no seals provided on the photograph insertion slots. Also each page has an aperture for accommodating two back to back photographs which could subject the photographs to physical damage.

There remains a need for a convenient, low-cost method for affixing a printed image onto a book cover that is appropriate for fabricating photo books in a retail environment without the need for specialized equipment or highly-trained operators.

SUMMARY OF THE INVENTION

The present invention represents a system for affixing a printed image onto a book cover, comprising:

- a sleeve having a front surface, a back surface and four edges including:
  - a front layer having a transparent window region surrounded by an opaque mask region;
  - a back layer joined to the front layer along at least two of the edges, wherein the back layer is not joined to the front layer along at least one of the edges thereby providing at least one open edge adapted to receive the printed image; and
  - adhesive strips having peelable coverings affixed onto the back surface of the sleeve along at least two of the edges;
- wherein the printed image is visible through the transparent window region and the edges of the printed image are covered by the opaque mask region when the printed image is inserted into the sleeve; and
- wherein the adhesive strips are adapted to affix the sleeve onto the book cover.

This invention has the advantage that it provides a simple-to-use attachment that holds and protects a photographic print and permanently affixes it to the cover of a photo book to give the look and feel of being a fully integrated part of the photo book. The opaque border is preferably designed to match or complement the cover of photo book in terms of color, pattern, texture or material.

It has the additional advantage that the printed image can be affixed to the cover of the photo book by an unskilled operator without the need for any specialized equipment. This makes it appropriate for use in a retail or home environment.

It is to be understood that the attached drawings are for purposes of illustrating the concepts of the invention and may not be to scale.

DETAILED DESCRIPTION OF THE INVENTION

Figure 1:
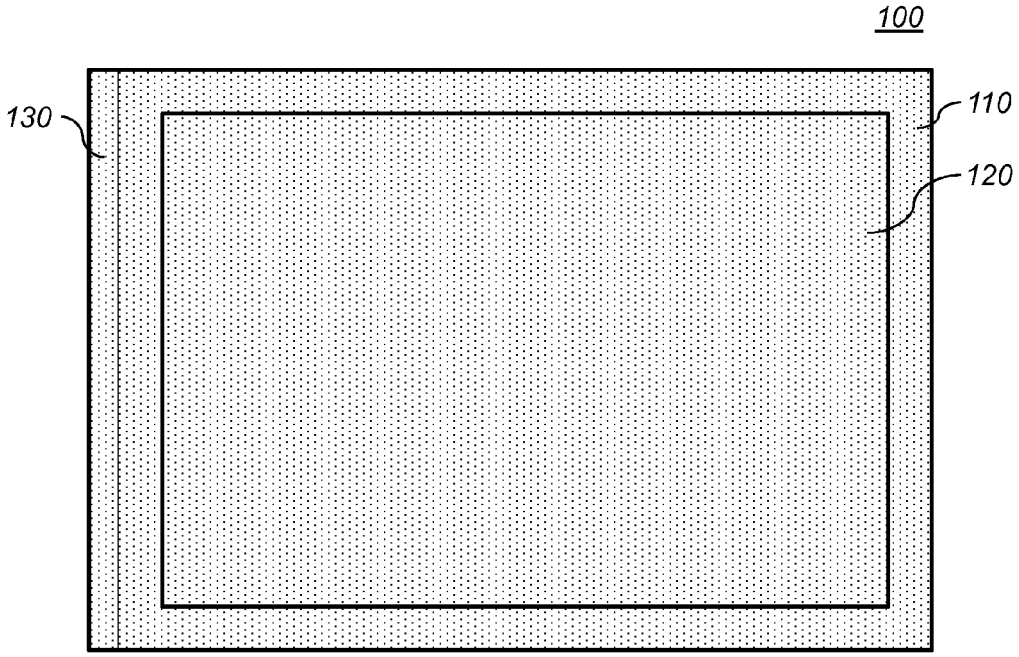
FIG. 1 is a front view of a photo book.
Figure 2:
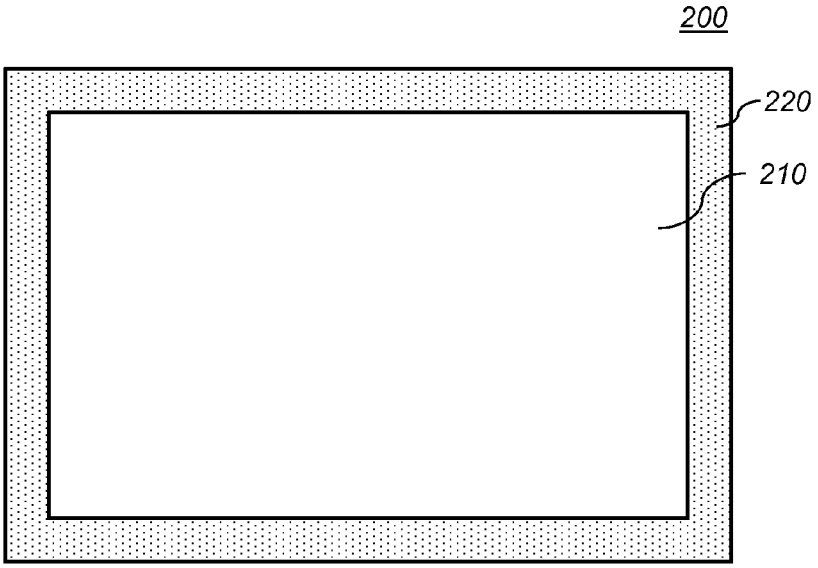
FIG. 2 is a front view of a photo sleeve for use with the photo book of FIG. 1 in accordance with an embodiment of the present invention.

The present invention will now be described with reference to the attached drawings. FIG. 1 shows a front view of a photo book 100. The photo book 100 has a book cover 110 connected to a spine 130. In a preferred embodiment, the book cover 110 includes a recessed region 120 sized to receive a photo sleeve 200 (FIG. 2), which is adapted to be used to affix a printed image onto the book cover 110. As shown in FIG. 2, the sleeve 200 includes a transparent window region 210, surrounded by an opaque mask region 220.

Figure 3:
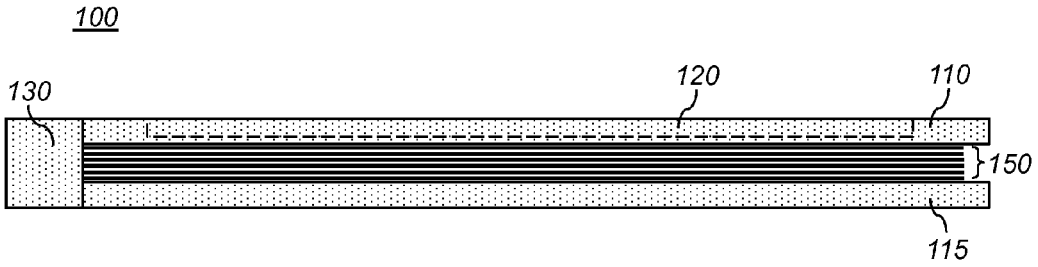
FIG. 3 is a side view of the photo book of FIG. 1.

FIG. 3 shows a side-view of the photo book 100. The recessed region 120 of the book cover 110 is shown in dashed outline. The photo book 100 generally includes a back cover 115, and a series of book pages 150. The book pages 150 can be permanently bound into the photo book 100 (e.g., using mechanisms such as staples, adhesives, stitching, or combinations thereof), or they can be bound using a non-permanent system (e.g., binder clip mechanisms, or ring binders).

In some embodiments, the photo book 100 is a photo album or a scrap album containing book pages 150 into which a user can arrange their own printed images and other content. For example, the book pages 150 can include sleeves for receiving the printed images, or they can be so-called "magnetic album pages" that include a thin, peelable film over a tacky surface, or they can be scrap book style pages onto which the printed images can be affixed using glue or photo corners.

In other embodiments, the photo book 100 can include book pages 150 that are custom printed using a customer-defined layout of the customer's images and are then bound together to form a custom photo book. Such custom photo books are offered for sale by many service providers such as Shutterfly. A barrier to creating high-quality custom photo books in a retail environment has been the ability to create a cover with a custom photograph without the need for specialized equipment (e.g., alignment fixtures, laminators, glue guns or staplers) or highly-trained operators. The present invention addresses this problem by providing an easy-to-use system for affixing a printed image onto a book cover 110 that is appropriate for use in a retail or home environment.

Figure 4:
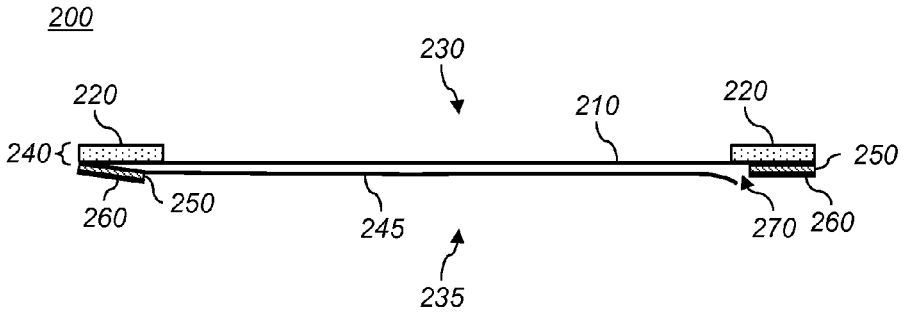
FIG. 4 is a cross-sectional side view of the photo sleeve of FIG. 2.

FIG. 4 is a cross-sectional side view of the sleeve 200 of FIG. 2. The sleeve 200 has a front surface 230 that will be visible when the photo sleeve is mounted to the photo book 100 (FIG. 1) and an opposing back surface 235. The sleeve 200 includes a front layer 240 that includes the transparent window region 210 and the surrounding opaque mask region 220 and a back layer 245.

Figure 5A:
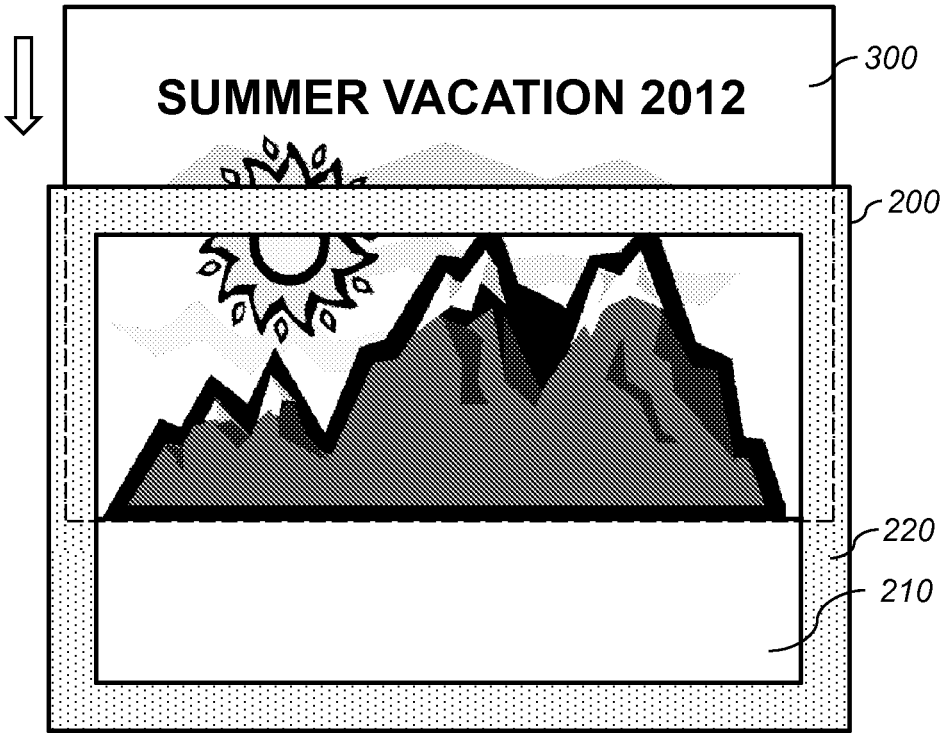
FIG. 5A is a front view of the photo sleeve of FIG. 2 with a print partially inserted.
Figure 5B:
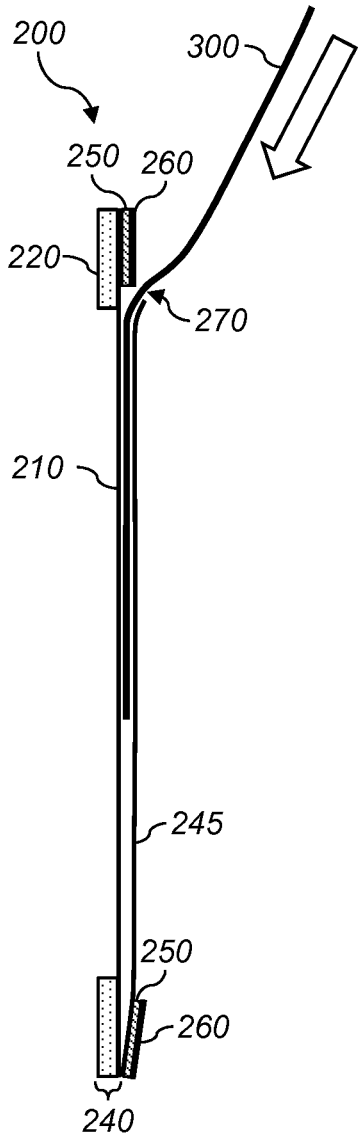
FIG. 5B is a cross-sectional side view of the photo sleeve of FIG. 2 with a print partially inserted.

Together, the front layer 240 and the back layer 245 from a pocket into which a hardcopy print 300 can be inserted (see FIGS. 5A-5B). The back layer 245 is joined to the front layer 240 along at least two edges and is not joined to the front layer 240 along at least one of the edges, thereby providing at least one opening 270 adapted to receive the hardcopy print 300. In a preferred embodiment, the back layer 245 is joined to the front layer 240 along three edges to provide a three-sided pocket with one open edge. The back layer 245 can be joined to the front layer 240 using any appropriate means. In some embodiments, they are joined by heat sealing the sides and bottom edge. Alternatively, the three edges can be sealed using an adhesive (e.g., glue).

The sleeve 200 also includes adhesive strips 250 (i.e., pressure sensitive tape) having peelable coverings 260 (i.e., release layers) affixed onto the back surface 235 along at least two of the edges. When the user has inserted the hardcopy print 300 into the sleeve 200 and is ready to attach it to the book cover 110, the peelable coverings 260 can be removed and the sleeve 200 can be permanently affixed by pressing it against the book cover. Preferably, adhesive strips 250 are provided along all four edges, and extend all the way to the edges, to firmly attach the sleeve to the book cover 110 around the entire perimeter.

In a preferred embodiment, one of the adhesive strips 250 is affixed to a portion of the front layer 240 that extends beyond the back layer 245 along the edge having the opening 270 as illustrated in FIG. 5B. In this way, when the sleeve 200 is affixed to the book cover 110 it seals the opening 270 thereby permanently enclosing the hardcopy print 300 within the sleeve. In this case, the sleeve 200 should be sized appropriately so that the hardcopy print 300 fits within the sleeve without extending beyond the back layer 245 and protruding out of the opening 270.

The transparent window region 210 can be fabricated using any appropriate transparent material through which the hardcopy print 300 can be viewed while providing protection against damage (e.g., from scratches, spills, fingerprints and general wear). Preferably, the transparent material is selected to be cleanable and to be resistant to damage. In some embodiments, the transparent window region 210 is made using a clear plastic such as polypropylene or vinyl. The transparent window region 210 can have a glossy surface or a non-glare matte surface in order to enhance or soften the appearance of the print as desired.

In some embodiments, the transparent window region 210 can also include text or graphics that will overlay the hardcopy print 300 to enhance the appearance. For example, the text can include thematic messages such as "Happy Birthday" or "Friends Forever." Similarly, the graphics can include thematic content such as wedding bells, snowflakes, stars or confetti. The text and graphics can be translucent or opaque, and can be pre-printed onto the surface of the transparent window region 210, or can be affixed using an adhesive.

The opaque mask region 220 is adapted to cover the edges of the hardcopy print 300 when it is inserted into the sleeve 200. In addition to the aesthetic appeal of hiding the edges of the hardcopy print 300, it provides the additional advantage that it will be more forgiving to alignment errors of the hardcopy print 300.

The opaque mask region 220 can be provided in a variety of different ways and using a variety of different materials. In some cases, the opaque mask region 220 can be printed onto the surface of the transparent window region 210. In other cases the opaque mask region 220 can be fabricated as a separate component using an appropriate material and affixed to the transparent window region 210 using an adhesive. The opaque mask region 220 can be fabricated using any appropriate material known in the art. Examples of appropriate materials would include a cardboard "matte" material, a cloth, a plastic sheet, a metallic sheet, or combinations thereof. In general, it will be desirable that opaque mask region 220 has a color, pattern, texture or material that matches the book cover 110, or is complementary to the book cover 110, to provide a pleasing aesthetic appearance.

In some embodiments, the opaque mask region 220 extends to the edges of the sleeve and is fabricated to match the appearance and material of the book cover 110 so that it appears to be integral with the photo book 100. Alternatively, the opaque mask region 220 can be differentiated from the book cover 110, but can use materials and colors that are complementary to the book cover 110. For example, if the photo book 100 is a leather photo album with gold metallic trim pieces, the opaque mask region 220 can be fabricated to have a gold metallic appearance that ties in with the trim pieces.

In some embodiments, the depth of the recessed region 120 on the book cover 110 can be matched to the total thickness of the sleeve 200 (i.e., the total thickness of the transparent window region 210, the opaque mask region 220, the back layer 245, the adhesive strip 250 and the hardcopy print 300), the surface of the opaque mask region 220 in the inserted sleeve 200 can be substantially flush with the surface of the book cover 110. In other embodiments, a larger depth of the recessed region 120 can be used such that the inserted sleeve 200 is recessed below the surface of the book cover 110 to provide a matting effect.

In some embodiments, the transparent window region 210, the opaque mask region 220 and the back layer 245, as well as the adhesive strips 250 with the peelable coverings 260, can be assembled together in the factory and provided to the user as a complete package that is ready to receive a hardcopy print 300 and attach to a photo book 100. In other embodiments, the various components can be assembled minus the opaque mask region 220 to form an open sleeve assembly. A selection of different opaque mask regions 220 (e.g., with different colors, patterns, textures or materials) can be fabricated independently and provided for selection by the user. The user can then select a desired opaque mask region 220 (e.g., the one that best complements the look of a particular photo book 100), and attach it to the open sleeve to provide the completed sleeve 200. In some configurations, the back of the opaque mask region 220 can be provided with one or more adhesive strips 250 with peelable coverings 260 that can be used to conveniently attach the opaque mask region 220 to the open sleeve assembly.

Figure 6:
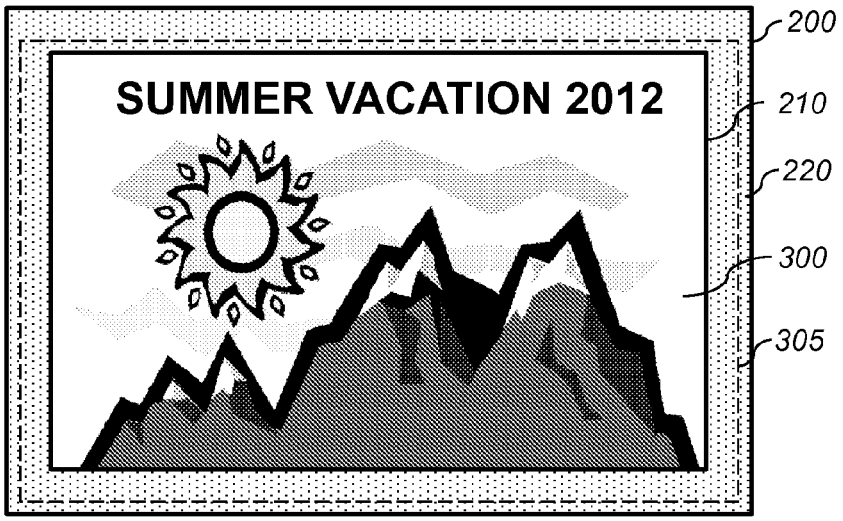
FIG. 6 is a front view of the photo sleeve of FIG. 2 with a print fully inserted.

FIG. 6 shows a front view of the sleeve 200 of FIG. 2 with a hardcopy print 300 fully inserted. The hardcopy print 300 is visible through the transparent window region 210. The edges 305 of the hardcopy print 300 are hidden behind the opaque mask region 220. In addition to being aesthetically pleasing, hiding the edges 305 of the hardcopy print 300 has the advantage of being insensitive to small alignment errors in the positioning of the hardcopy print 300. Additionally, some printing technologies (e.g., many inkjet printers) are not capable of producing borderless (i.e., "full-bleed") prints. In this case, hiding the edges 305 of the hardcopy print 300 makes it unnecessary to trim any undesired borders from the edges of the hardcopy print 300 before inserting it into the sleeve 200.

Figure 7:
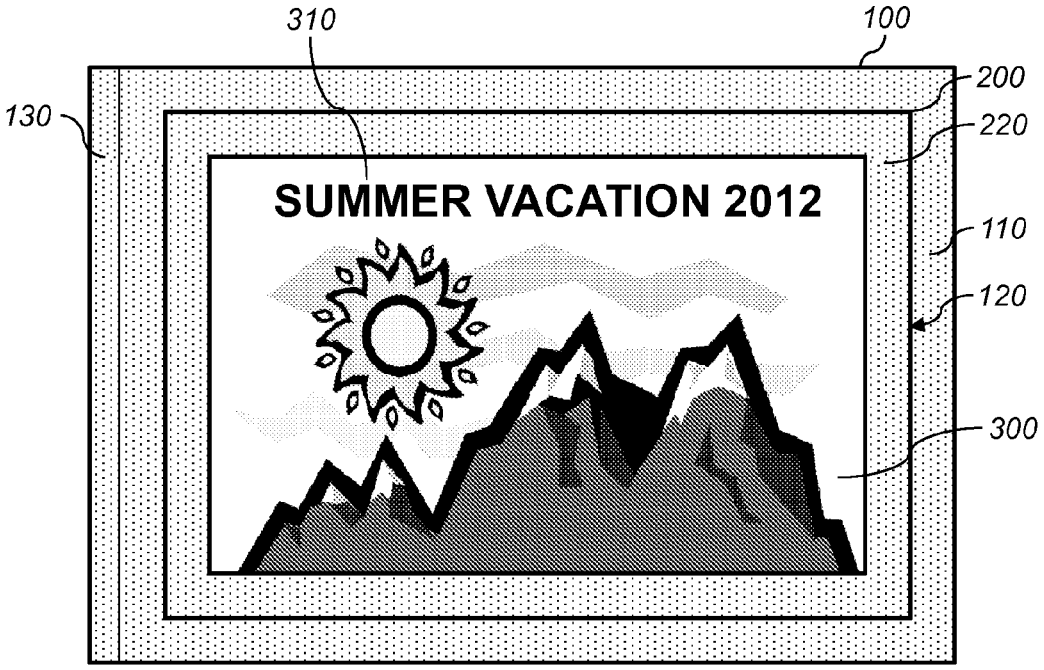
FIG. 7 shows the photo book of FIG. 1 with the photo sleeve with the inserted print of FIG. 6 attached.

FIG. 7 shows the photo book of FIG. 1 with the sleeve 200 having the inserted hardcopy print 300 of FIG. 6 attached. The sleeve 200 is inserted into the recessed region 120 in the book cover 110. The recessed region 120 is preferably sized to be slightly larger than the outer dimensions of the sleeve 200 (i.e., the outer dimensions of the opaque mask region 220) so that there is a small margin around the border of the sleeve 200 in order to make the alignment and insertion process easy. In the illustrated example, the hardcopy print 300 includes a title 310 that relates to the content of the photo book 100. The title 310 is preferably added to the image using appropriate image processing software before the hardcopy print 300 is printed.

Figure 8A:
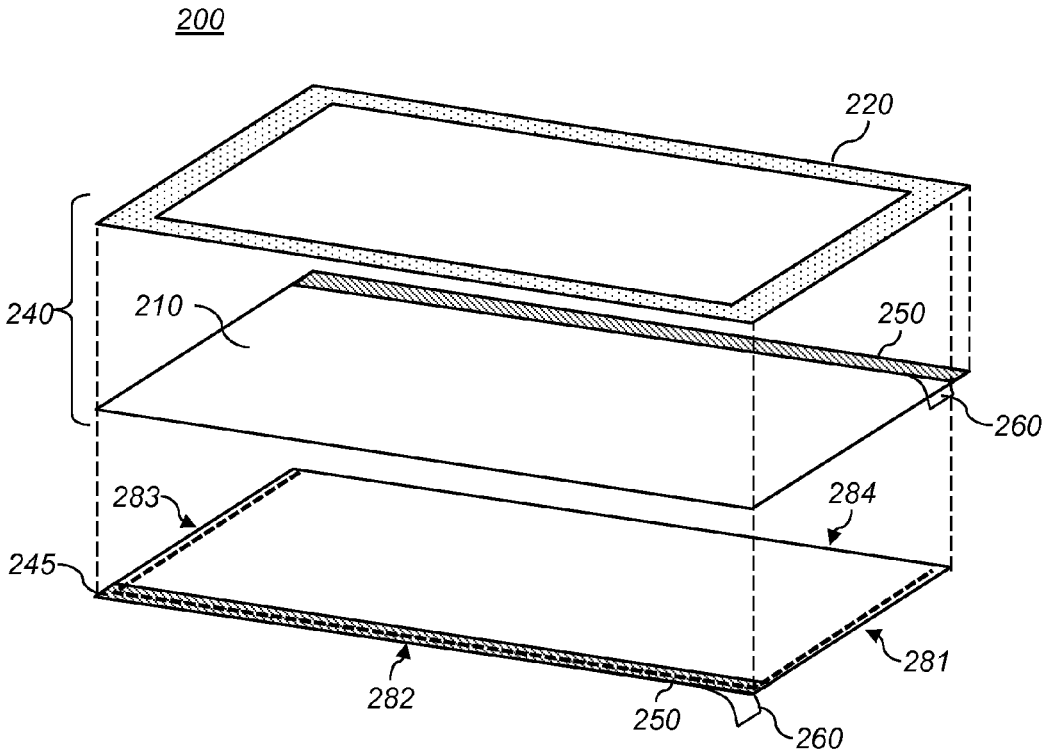
FIG. 8A shows an exploded side view of the photo sleeve of FIG. 2.

FIG. 8A shows an exploded side view of the sleeve 200 of FIG. 2 illustrating the assembly of the individual components according to an exemplary embodiment. The front layer 240 is fabricated by cutting out the opaque mask region 220 from an appropriate material and affixing it to the transparent window region 210. The front layer 240 is then connected to the back layer 245 by joining them along three edges 281, 282, 283 (as represented by the dotted line along these edges). A fourth edge 284 is left open to provide the opening 270 (FIG. 5B) through which the hardcopy print 300 (FIG. 5B) can be inserted. Adhesive strips 250 with peelable coverings 260 are provided along the bottom edge 282 and the top edge 284. In this example, the front layer 240 extends beyond the back layer 245 along the top edge 284 so that the adhesive strip 250 along the top edge 284 is attached to the back surface of the front layer 240, while the adhesive strip 250 along the bottom edge 282 is attached to the back surface of the back layer 245.

Figure 8B:
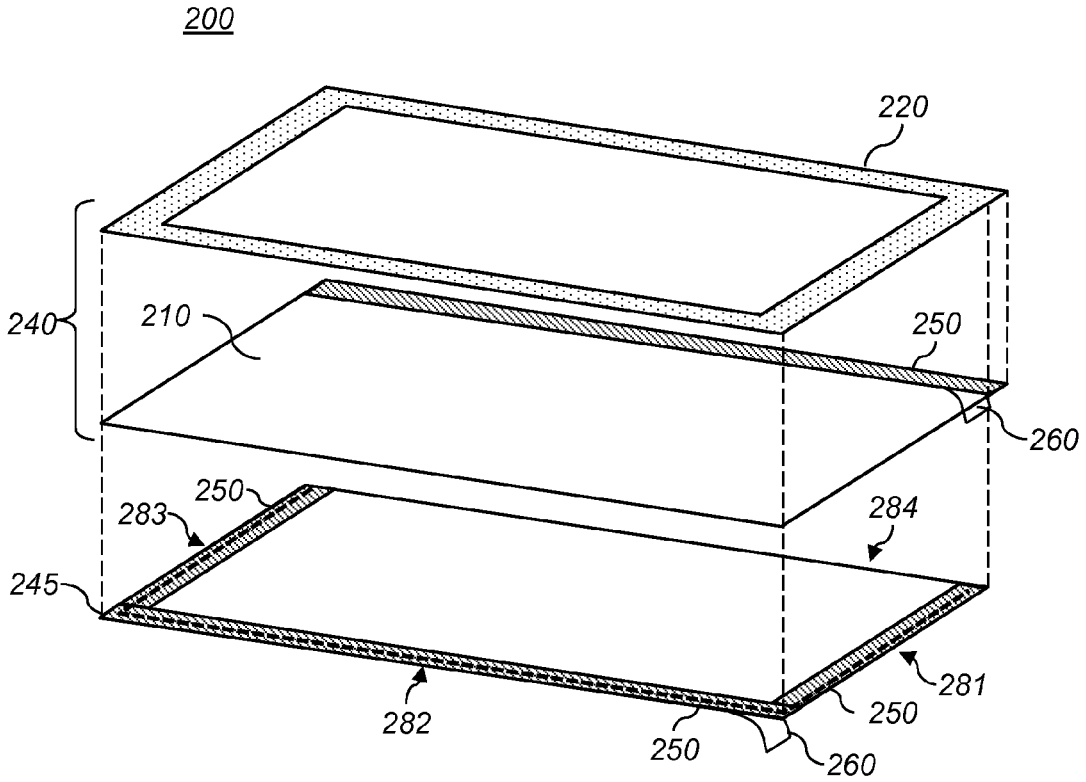
FIGS. 8B and 8C shows exploded side views of photo sleeves according to alternate embodiments.

FIG. 8B illustrates an alternate embodiment where adhesive strips 250 are provided along all four edges of the sleeve 200. The adhesive strip 250 along the top edge 284 is attached to the back surface of the front layer 240, while the adhesive strips 250 along the other three edges 281, 282, 283 are attached to the back surface of the back layer 245. This embodiment is advantaged relative to that shown in FIG. 8A in that the sleeve 200 will be adhered to the book cover 110 along all four edges, therefore providing a more secure attachment.

Figure 8C:
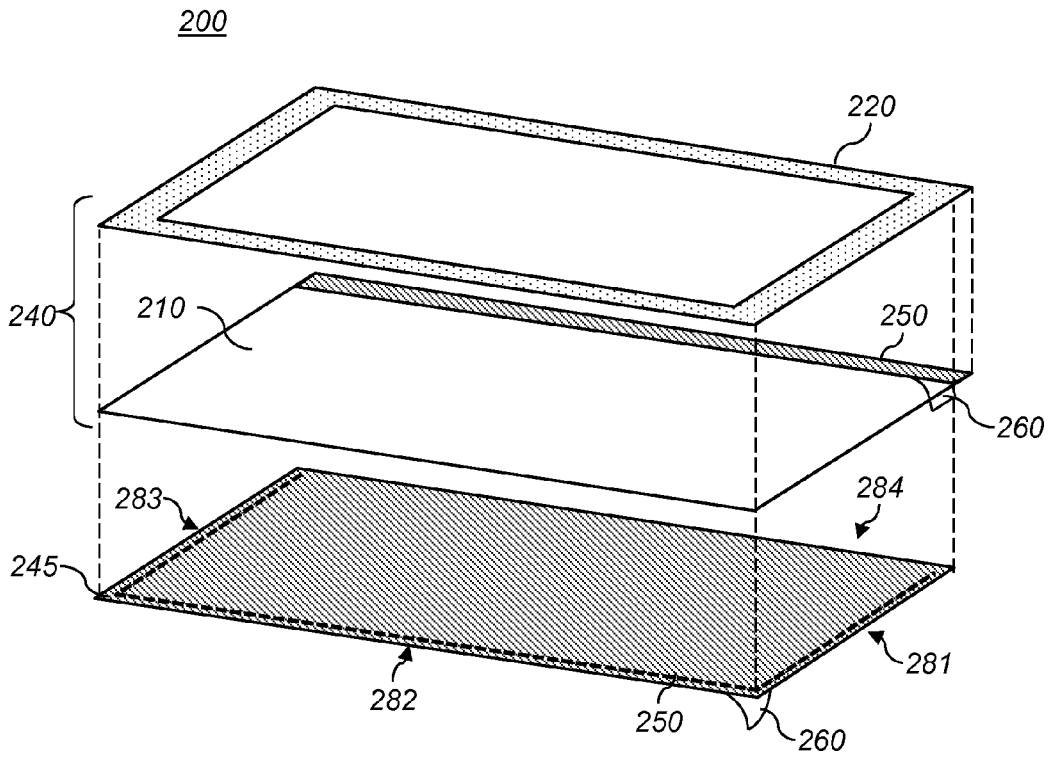

FIG. 8C illustrates an third embodiment where the entire back surface of the back layer 245 is covered by a single large adhesive strip 250 that extends to the three edges 281, 282, 283. Another narrow adhesive strip 250 is attached to the back surface of the front layer 240 along the top edge 284. In this case, the sleeve 200 will be even more firmly adhered to the book cover 110, although the larger area covered by the adhesive strip 250 can cause the sleeve 200 to be more difficult to handle during the process of attaching it to the book cover 110.

Figure 9A:
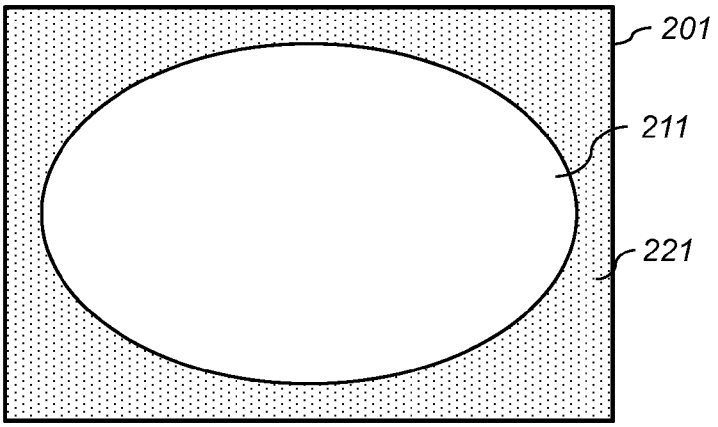
FIGS. 9A-9C show exemplary opaque masks that can be used in accordance with the present invention.
Figure 9B:
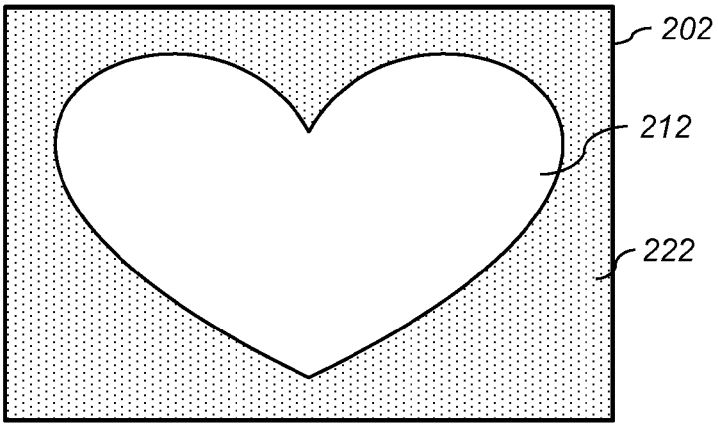

In the previously described embodiments, the opaque mask region 220 is shown as having a rectangular opening through which the hardcopy print 300 is visible (e.g., see FIG. 2). In other embodiments, the opaque mask region 220 can have a variety of different arrangements. In some cases, the opaque mask region 220 can have openings with non-rectangular shapes. For example, FIG. 9A shows a sleeve 201 where the opening in opaque mask region 221 provides an oval-shaped transparent window region 211. Similarly, FIG. 9B shows a sleeve 202 where the opening in opaque mask region 222 provides a heart-shaped transparent window region 212.

Figure 9C:
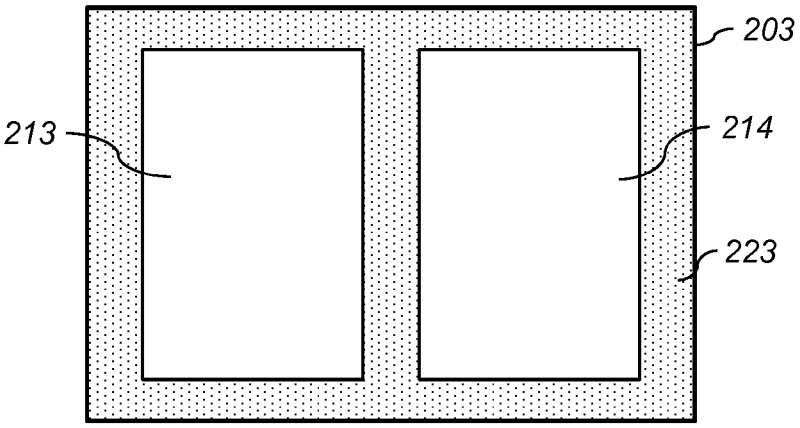

In some embodiments, the opaque mask region 220 can have a plurality of openings to provide a plurality of transparent window regions 210. For example, FIG. 9C shows a sleeve 203 having an opaque mask region 223 that includes two openings to provide two transparent window regions 213, 214. In this case, the sleeve 203 is adapted to receive two different hardcopy prints 300, which will each be visible through a corresponding transparent window region 213, 214.

Figure 10:
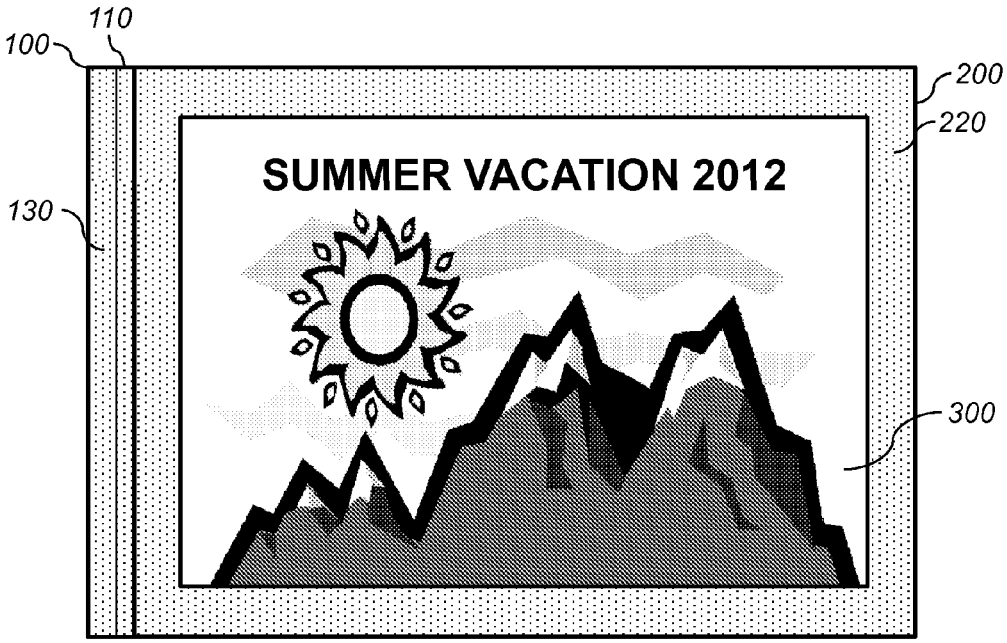
FIG. 10 shows an alternate embodiment where a photo sleeve is affixed directly onto the surface of the book cover.

In the previously described embodiments, the book cover 110 of the photo book 100 includes a recessed region 120 into which the sleeve 200 can be inserted (e.g., see FIG. 1). In other embodiments, the sleeve 200 can be affixed directly onto a book cover 110 with a flat front surface. For example, FIG. 10 shows an embodiment where the sleeve 200 is affixed directly onto the book cover 110 of photo book 100. In this case, the sleeve 200 extends all the way to the edges of the book cover 110 on the top, bottom and right sides so that the edges of the sleeve 200 are flush with the corresponding edges of the book cover 110. With this configuration, it is generally desirable that all four edges of the sleeve be attached using the adhesive strips (e.g., using the arrangements illustrated in FIGS. 8B-8C). The embodiment depicted in FIG. 10 has the advantage that the hardcopy print 300 can be made to cover almost the entire surface of the book cover 110. A disadvantage of this approach is that the edges of the sleeve 200 are not hidden within the recessed region 120 (FIG. 1). As a result, the edges of the sleeve 200 may be more susceptible to damage as the photo book 100 is handled.

Figure 11:
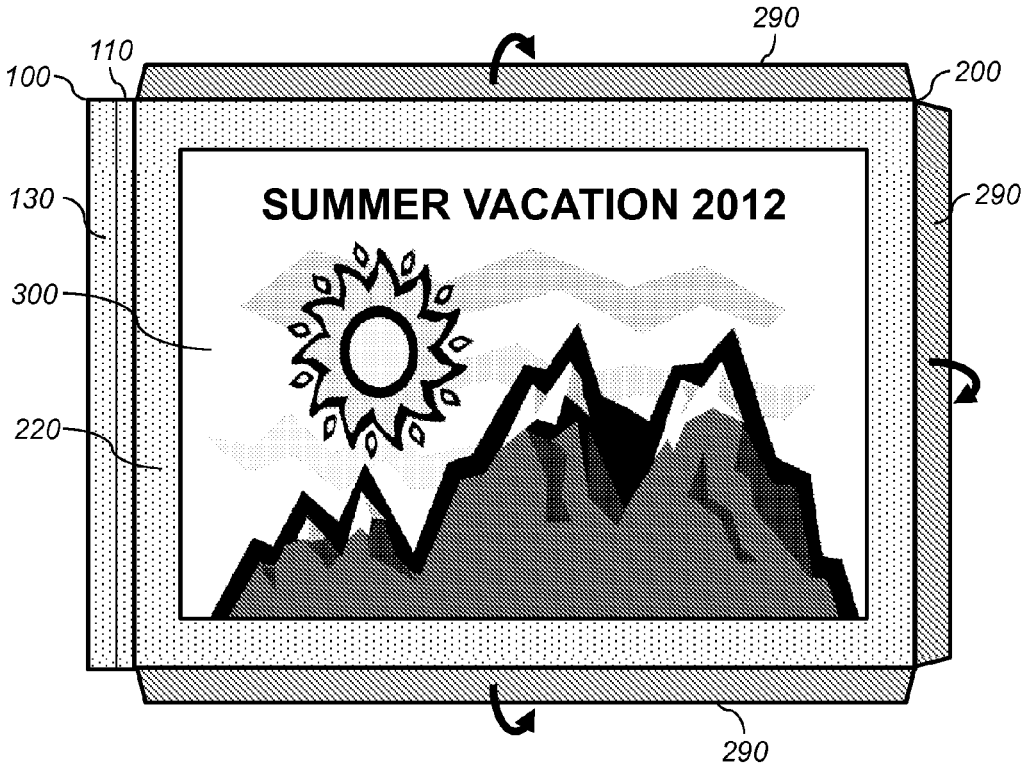
FIG. 11 shows an alternate embodiment where the photo sleeve includes flaps that extend outward from the edges of the opaque mask region.

FIG. 11 shows another embodiment where the sleeve 200 includes flaps 290 that extend outward from the edges of the opaque mask region 220. In the illustrated configuration, flaps 290 are provided on all of the edges except the edge toward the spine 130 (i.e., on the top, bottom and right edges). Adhesive strips 250 (not shown in FIG. 11) are provided on the back of each flap 290 so that they can be wrapped around the corresponding edges of the book cover 110 and affixed to the rear surface of the book cover. In some configurations the flaps 290 can be an extension of the opaque mask region 220, and can be made out of the same material as the book cover 110 to provide a seamless appearance to the photo book 100.

Preferably, the sleeve 200 (FIG. 2) is sized to receive a standard-size hardcopy print 300 (e.g., 4×6 inches, 5×7 inches or 8×10 inches). In this way, it is not necessary to produce hardcopy prints 300 having a custom size, or to perform a trimming operation to adjust the size of the hardcopy prints 300. In some embodiments, a set of different sleeves 200 can be provided for use with a particular photo book 100, where each sleeve 200 is adapted to be used with a different size hardcopy print 300. In this case, the outer dimensions of the sleeves 200 can all be the same (e.g., 9×11 inches) so that they can be inserted into a standard-size recessed region 120. The different print sizes are accommodated by providing sleeves with corresponding transparent window region 210 sizes.

The invention has been described in detail with particular reference to certain preferred embodiments thereof, but it will be understood that variations and modifications can be effected within the spirit and scope of the invention.

PARTS LIST

100 photo book
110 book cover
115 back cover
120 recessed region
130 spine
150 book pages
200 sleeve
201 sleeve
202 sleeve
203 sleeve
210 transparent window region
211 transparent window region
212 transparent window region
213 transparent window region
214 transparent window region
220 opaque mask region
221 opaque mask region
222 opaque mask region
223 opaque mask region
230 front surface
235 back surface

240 front layer
245 back layer
250 adhesive strip
260 peelable covering
270 opening
281 edge
282 edge
283 edge
284 edge
290 flap
300 hardcopy print
305 edges
310 title

The invention claimed is:

1. A printed image display system, comprising:

a book cover having a front surface and a rear surface; and a sleeve having a front surface, a back surface and four edges including:

a front layer having a transparent window region surrounded by an opaque mask region;

a back layer joined to the front layer along at least two of the edges, wherein the back layer is not joined to the front layer along at least one of the edges thereby providing at least one open edge adapted to receive a printed image; and adhesive strips having peelable coverings affixed onto the back surface of the sleeve along at least two of the edges, the adhesive strips being adapted to affix the sleeve onto the book cover;

wherein when a printed image is inserted into the printed image display sleeve the printed image is visible through the transparent window region and the edges of the printed image are covered by the opaque mask region when the printed image is inserted into the sleeve; and wherein the front layer extends beyond the back layer along at least one of the open edges, and wherein one of the adhesive strips is affixed to the portion of the front layer that extends beyond the back layer such that when the sleeve is affixed to the book cover it seals the open edge.

2. The printed image display system of claim 1 wherein the sleeve fits into a recessed area on the book cover.

3. The printed image display system of claim 2 wherein a depth of the recessed area is substantially equal to a thickness of the sleeve such that the front surface of the sleeve is substantially flush with a front surface of the book cover when the sleeve is inserted into the recessed area.

4. The printed image display system of claim 2 wherein a depth of the recessed area is greater than a thickness of the sleeve such that the front surface of the sleeve is recessed below a front surface of the book cover when the sleeve is inserted into the recessed area.

5. The printed image display system of claim 1 wherein when the sleeve is affixed to the book cover at least one edge of the sleeve is flush with a corresponding edge of the book cover.

6. The printed image display system of claim 1 wherein when the sleeve is affixed to the book cover at least one edge of the sleeve is wrapped around a corresponding edge of the book cover and affixed to a rear surface of the book cover.

* * * * *